United States Patent [19]

Inada

[11] Patent Number: 4,505,267

[45] Date of Patent: Mar. 19, 1985

[54] PORTABLE MASSAGING DEVICE

[76] Inventor: Nichimu Inada, 4-25, Morofuku 5-chome, Daitoshi, Osaka, Japan

[21] Appl. No.: 407,528

[22] Filed: Aug. 12, 1982

[30] Foreign Application Priority Data

Mar. 9, 1982 [JP] Japan ..... 57-32961[U]

[51] Int. Cl.[3] ..... A61H 7/00

[52] U.S. Cl. ..... 128/49; 128/59; 128/55

[58] Field of Search ..... 128/44, 49, 52, 54, 128/55, 60, 61, 64, 33

[56] References Cited

U.S. PATENT DOCUMENTS

| | | | |
|---|---|---|---|
| 2,664,882 | 1/1954 | Parker | 128/33 |
| 2,964,037 | 12/1960 | Johnston | 128/49 |
| 4,016,872 | 4/1977 | Yamamura et al. | 128/44 |
| 4,150,668 | 4/1979 | Johnston | 128/49 |

*Primary Examiner*—Richard J. Apley
*Assistant Examiner*—David J. Brown
*Attorney, Agent, or Firm*—Lucas & Just

[57] ABSTRACT

A portable massaging device includes a casing having a handle, a pad fixed to the casing, and a pair of muscle relaxing wheels rotatively housed in the casing, wherein the pad and the muscle relaxing wheels are driven by the same electric motor mounted in the casing. The pad is caused to vibrate as a see-saw so as to give light patting on the human body.

1 Claim, 3 Drawing Figures

PORTABLE MASSAGING DEVICE

The present invention relates to a portable massaging device, and more particularly, to a portable massaging device which comprises a pair of muscle relaxing wheels in the upper section of the casing and a vibtrating pad in the lower section thereof, wherein the wheels and the pad are driven by the same electric motor. The device is compact-sized, and light so as to be readily operated and carried by hand. The vibrating pad is featured by its see-saw motion, which has been found most effective to relax or releive muscular stiffness.

A bed type or chair type of massaging devices are known and widely used. However, these known devices occupy a large space, and their mechanism is complicated. Even if their muscle relaxing effect has nothing to be complained about, their size and price are a problem. For example, if an office worker wants to relax his muscular fatigure in his office, it will not be achieved in an accessible way, and he must go to a special room in which a bed type of massaging device is installed. If he buys such type of device for use at home, he must provide a special space for accommodating the device. The same thing can be said about a chair type of massaging device.

In order to meet a demand for a portable or handy massaging device, the present invention has been made, particularly on the basis of the discovery that a mere vibration is not effective to relieve muscular fatigue, and that a see-saw motion is effective to relax muscular stiffness.

Therefore, it is a principal object of the present invention to provide a portable massaging device which can effectively relax muscle and remove muscular fatigue regardless of its small-size.

Another object of the present invention is to provide a portable massaging device which can be operated and carried by hand anywhere, such as in an office, in a home, in a car or even in a baseball players' dugout.

Other objects and advantages of the present invention will become more apparent from the following description when taken in connection with the accompanying drawings, which show, for the purpose of illustration only, an embodiment of the portable massaging device.

According to one aspect of the present invention, there is provided a massaging device which includes a casing having a handle, a pad fixed to the casing through a pair of first elastic elements, an electric motor accommodated in the casing, an eccentric cam secured to the motor shaft, a crank member engaging with the eccentric cam whereby the crank member is caused to move up and down in a circular manner, a pair of muscle relaxing wheels rotated by the motor, a covering for covering the muscle relaxing wheels in contact with the rims thereof, the covering being fixed to the casing, and means for transmitting the circular motion of the crank member to the pad, the transmission means including a second elastic element secured to the crank member at a point adjacent to the brim of the pad, and the first elastic elements being spaced from the first elastic element and aligned with the centerline extending along the width of the pad, thereby enabling the pad to move like a see-saw around the first elastic elements.

The invention will be more particularly described by way example, with reference to the accompanying drawings, in which.

Figure 3:
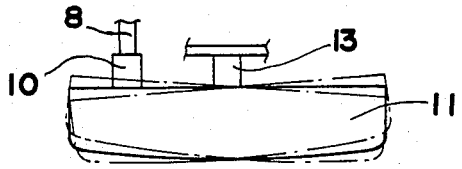
FIG. 3 is an extremely schematical view showing the see-saw motion of the pad.

A portable massaging device 1 consists, in its outer appearance, of a casing 3 having a handle 2, a covering 17 fixed to the casing 3, and a pad 11 fixed so as to allow same to move like a see-saw. Internally, the device 1 includes an electric motor 4 whose shaft 5 carries an eccentric cam 6. The eccentric cam 6 is fitted in a hole produced in a crank member 8 through a ball-bearing 7 such that when the eccentric cam 6 is rotated, the crank member 8 moves up and down in a circular manner. The leg portion of the crank member 8 is fixed to a frame 12 of the pad 11 through an elastic cylinder 10: Elastic cylinder 10 is located at a point adjacent to the brim of the pad 11 as shown in FIG. 3. This ensures that the force of the crank member 8 is to produce the see-saw motion of the pad 11.

The bottom 3*a* of the casing 3 is fixed to the frame 12 of the pad 11 through two elastic cylinders 13*a*, 13*b*, which are spaced from the elastic cylinder 10 and aligned with the centerline extending along the width of the pad 11. These elastic cylinders 13*a*, 13*b* are intended to provide a center around which the see-saw motion of the pad 11 is effected as shown in FIG. 3. In this case the provision of two pieces ensures the stability of the see-saw motion, which is essential for the even application of force to the human body.

Figure 1:
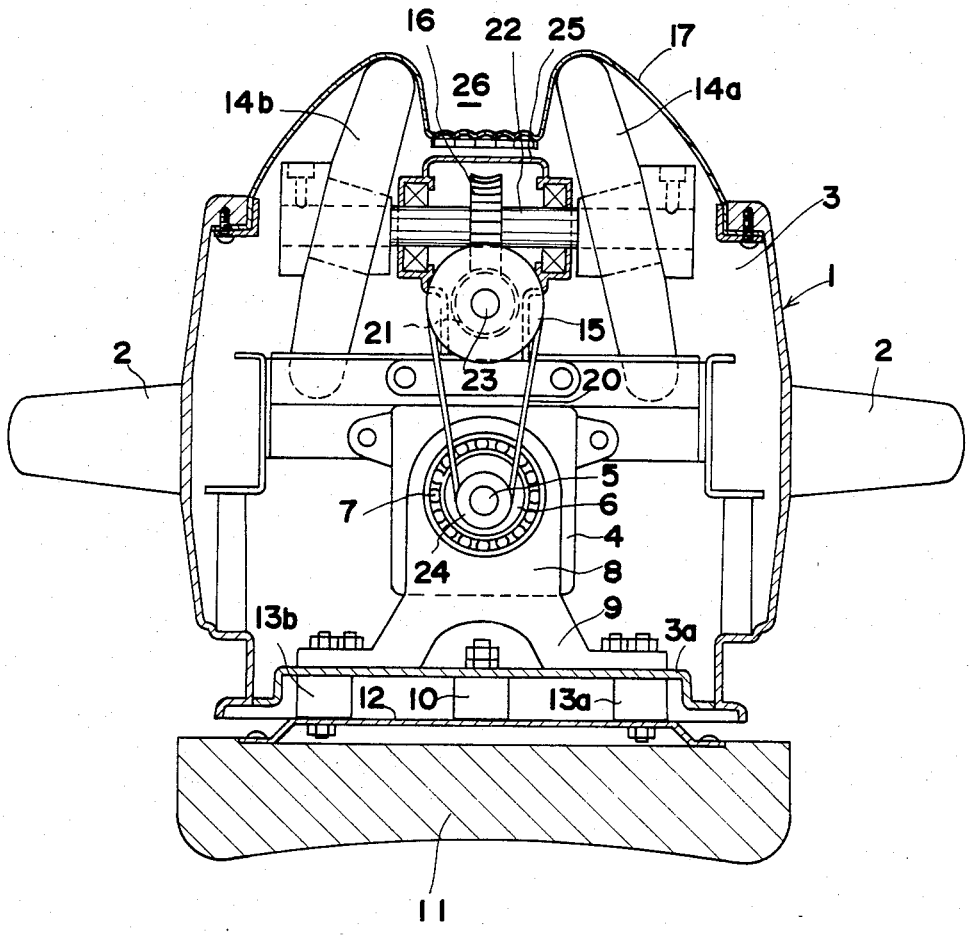
FIG. 1 is a vertical cross-section through a portable massaging device according to the present invention.
Figure 2:
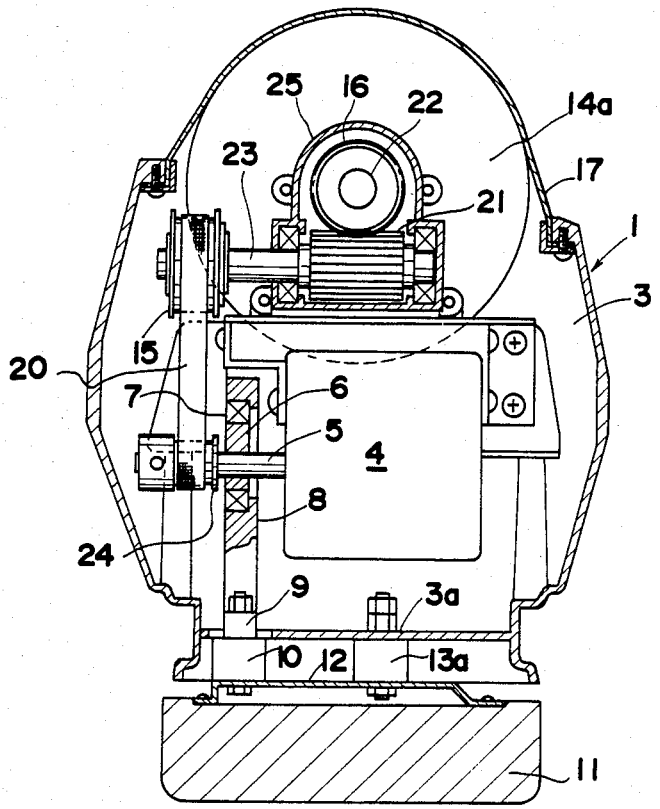
FIG. 2 is a vertical cross-section through the device of FIG. 1, taken from the righthand side of FIG. 1.

The massaging device 1 also includes a pair of muscle relaxting wheels 14*a*, 14*b* under the covering 17, which is made of a soft, tough material, such as leather. As shown in FIGS. 1 and 2, the rims of the muscle relaxing wheels 14*a*, 14*b* are kept in contact with the inside surfaces of the covering 17 so as to transmit the circular motion of the wheels to the human body through the covering 17. The muscle relaxing wheels 14*a*, 14*b* are carried on a shaft 22 such that the wheels 14*a*, 14*b* are inwardly inclided thereon as shown in FIG. 1. The reference numeral 26 designates a recess defined by the inclined rims of the wheels 14*a*, 14*b*, in which the user can optionally place his neck to obtain relaxation around his neck and shoulder. The shaft 22 has a gear 16 fixed thereto, which is in mesh with a gear 21 carried on the shaft 23 of a pulley 15. The pulley 15 is connected by a belt 20 to a pulley 24 carried on the motor shaft 5. In this way, when the motor 4 is driven, the muscle relaxing wheels 14*a*, 14*b* are rotated. The reference numeral 25 designates a gear case.

In operation, the motor 4 is switched on. The crank member 8 starts its circular motion through the eccentric cam 6, and at the same time the muscle relaxing wheels 14*a*, 14*b* start their rotation. The circular motion of the crank member 8 is transmitted to the pad 11 through the elastic cylinder 10, thereby causing the pad 11 to move forcefully up and down at the force applied point. This causes a see-saw movement of the pad 11 as a whole around the elastic cylinders 13. The human body receives light pattings alternately on two points.

What is claimed is:

1. A portable massaging device comprising:

a casing having a handle, said handle comprising two bars extending in opposite directions so as to enable the user to grip said handle with his both hands;

a pad;

a pair of first elastic elements fixing said pad to said casing;

an electric motor in said casing;

a shaft connected to said motor;

an eccentric cam secured to said shaft of said motor;

a crank member engaging said eccentric cam whereby said crank member is caused to move up and down in a circular manner;

a pair of muscle relaxing wheels rotatably mounted in said casing and said muscle relaxing wheels are inwardly inclined towards each other;

a covering for covering said muscle relaxing wheels in contact with the rims thereof said covering being fixed to said casing;

said covering having a recess between said pair of wheels, said recess being wide enough to accommodate a neck of a user;

a first means for transmitting the drive from said electric motor to said muscle relaxing wheels, said first transmission means comprising a gearing, a belt and a pulley;

a second means for transmitting the circular motion of said crank member to said pad, said second transmission means comprising a second elastic element secured to said crank member and secured to said pad at a point adjacent to the brim of said pad; and said first elastic elements being spaced from said second elastic element and aligned with the centerline extending along the width of said pad, thereby enabling said pad to move like a see-saw around said first elastic elements.

* * * * *